US007819248B1

(12) United States Patent
Takach

(10) Patent No.: US 7,819,248 B1
(45) Date of Patent: Oct. 26, 2010

(54) LADDER CADDY

(76) Inventor: Robert J. Takach, 2935 S. Tioga Way, Las Vegas, NV (US) 89117

( * ) Notice: Subject to any disclaimer, the term of this patent is extended or adjusted under 35 U.S.C. 154(b) by 343 days.

(21) Appl. No.: 11/776,042

(22) Filed: Jul. 11, 2007

(51) Int. Cl.
*B65D 85/42* (2006.01)

(52) U.S. Cl. ..... 206/419; 206/443

(58) Field of Classification Search ..... 206/446, 206/443, 418, 419, 420, 421, 372, 373; 383/39; 220/507
See application file for complete search history.

(56) References Cited

U.S. PATENT DOCUMENTS 2,850,152 A * 9/1958 Marrufo ..... 206/234
2,927,687 A * 3/1960 Sanford ..... 206/419
3,369,859 A * 2/1968 Cornelius ..... 206/213.1
3,448,853 A * 6/1969 Repko ..... 206/470
3,905,529 A * 9/1975 Leu ..... 206/443
4,244,660 A * 1/1981 Aronson ..... 402/79
4,396,120 A * 8/1983 Morita ..... 206/460
4,613,042 A * 9/1986 Aeschliman ..... 206/419
D290,584 S * 6/1987 Lotterer ..... D9/732
4,785,980 A * 11/1988 Redick ..... 224/535
4,858,763 A * 8/1989 Scott ..... 206/419
4,887,713 A * 12/1989 Tupper ..... 206/225
4,958,731 A * 9/1990 Calcerano ..... 206/705
5,097,975 A * 3/1992 Waterston et al. ..... 220/23.83
5,190,377 A * 3/1993 Kelly ..... 383/29
5,209,352 A * 5/1993 Light et al. ..... 206/391
5,265,719 A * 11/1993 Wand ..... 206/223
5,337,907 A * 8/1994 McKenzie et al. ..... 211/88.01
5,344,004 A * 9/1994 Meyer ..... 206/45.25
5,501,382 A * 3/1996 Webb ..... 224/673
5,542,535 A * 8/1996 Dalton ..... 206/419
5,593,061 A * 1/1997 Prochnow ..... 220/507
5,639,003 A 6/1997 Utzinger, III
5,647,453 A 7/1997 Cassells
5,816,408 A * 10/1998 Indelicato ..... 206/581
D410,551 S 6/1999 Guimont et al.
5,934,468 A * 8/1999 Scott ..... 206/418
5,992,624 A * 11/1999 Hodson ..... 206/372
6,079,559 A * 6/2000 Lee ..... 206/378
6,305,498 B1 10/2001 Itzkovitch
6,435,304 B1 8/2002 Stierle
6,450,337 B1 9/2002 Campagna et al.
6,536,590 B1 3/2003 Godshaw et al.
6,564,941 B2 5/2003 Hedges
6,766,881 B2 7/2004 Carty
6,892,858 B1 * 5/2005 Zupan ..... 182/129
6,929,117 B1 * 8/2005 Cohen ..... 206/45.25
7,055,652 B1 6/2006 Williams
7,383,954 B2 * 6/2008 Morrison ..... 206/576
7,455,178 B2 * 11/2008 Miller, Jr. ..... 206/315.1
7,559,514 B1 * 7/2009 Wynter ..... 248/145.6
2002/0092785 A1 * 7/2002 Lungo ..... 206/373
2006/0011502 A1 * 1/2006 Redzisz ..... 206/373
2006/0243622 A1 * 11/2006 Lyman ..... 206/443

* cited by examiner

*Primary Examiner*—Jacob K Ackun, Jr.
(74) *Attorney, Agent, or Firm*—Greenberg Traurig

(57) ABSTRACT

Described is a caddy that allows an individual to access equipment, tools and supplies. The caddy includes a front panel portion having a series of elongated slots adapted in one version to receive and maintain elongate fluorescent lights. The caddy is attachable to a ladder so that users do not have to continuously climb up and down the ladder.

7 Claims, 5 Drawing Sheets

LADDER CADDY

FIELD OF THE INVENTION

The embodiments of the present invention relate to tool carriers, more specifically, to a caddy that allows an individual to access equipment, tools and other supplies.

BACKGROUND

Ladders are routinely used to access areas that are above standing height. At times, ladders can also serve as work platforms. Anyone who has used a ladder is well aware that even the slightest body movements can cause items placed on the ladder to tumble from the ladder to the ground. Not only can falling objects, such as heavy or sharp tools injure bystanders, but the person on the ladder can lose his or her balance in an attempt to catch such falling objects.

Thus, there exists a need for a ladder caddy that allows an individual to conveniently access various items such as equipment, tools and supplies while working on or proximate a ladder.

SUMMARY

Accordingly, a first embodiment of the present invention discloses a caddy comprising: a flat panel having a front and rear surface; a storage panel on a front surface of said flat panel; and means for mounting the caddy to a rigid object. The rigid object may be a ladder. The flat panel and storage panels can be constructed of plastic, fiberglass, PVC, metal or wood and be substantially rectangular, square, circular, triangular or trapezoidal. In one embodiment, the storage means comprises elongated slots. In one embodiment, the flat panel can incorporate a handle. The means for mounting the caddy to a rigid object, can include apertures and fastening means that can be passed through the apertures, the fastening means including Velcro straps, hooks or adjustable buckles.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
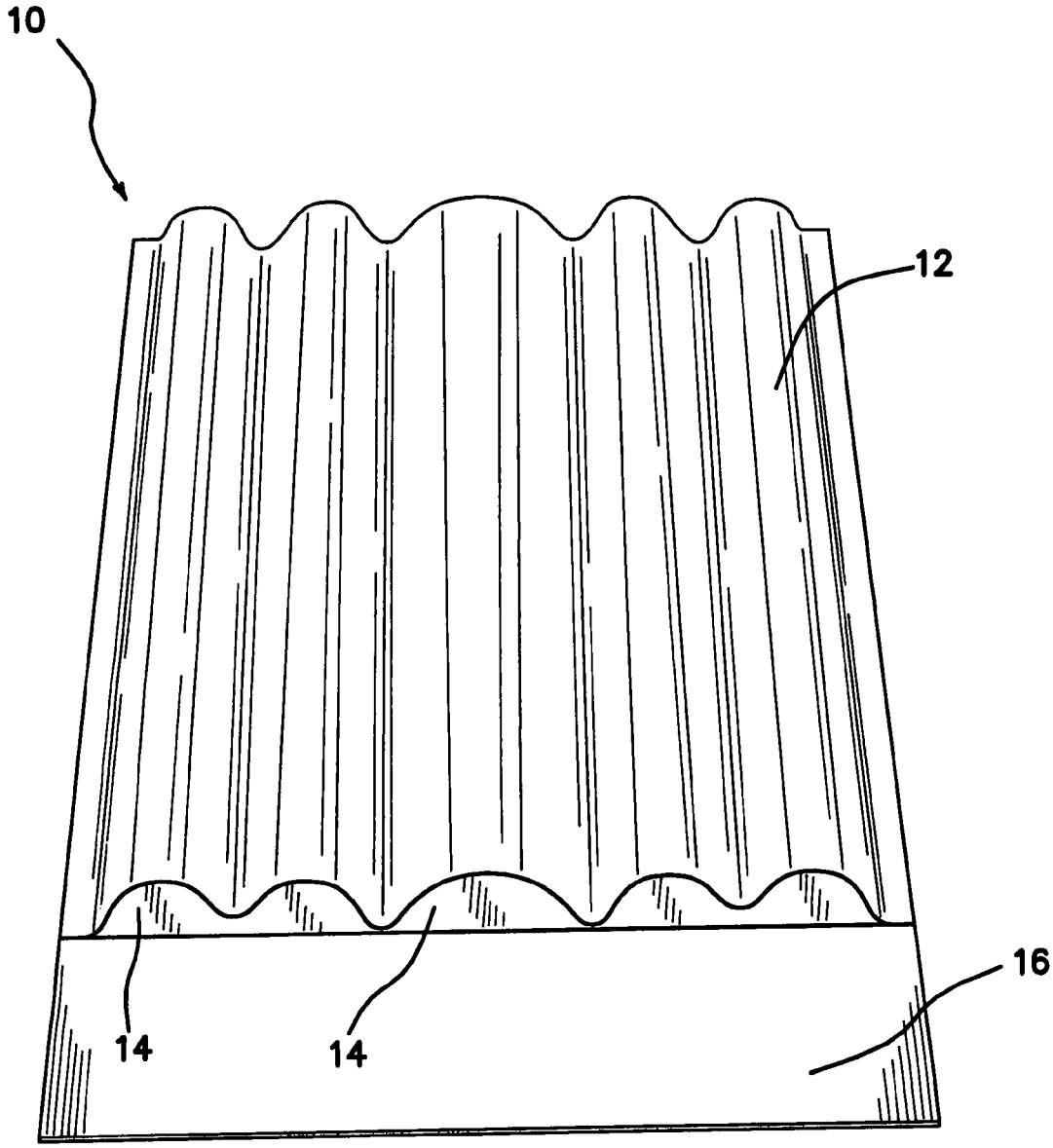
FIG. 1 illustrates a perspective view of a first embodiment of a caddy.

Initial reference is made to FIG. 1 illustrating a caddy 10 according to the embodiments of the presently disclosed invention. In one embodiment, the caddy 10 is constructed or molded (e.g., plastic injection) of plastic, polyurethane, fiberglass or PVC. Alternatively, the caddy 10 can also be made of metal, wood or any other suitable material. Although shown as substantially rectangular, the caddy 10 can take on any number of shapes and sizes. The caddy 10 includes a storage panel 12 having a plurality of elongated slots or pockets 14 formed thereon. In one embodiment, the slots 14 are adapted for retaining fluorescent light bulbs, tubes, starters and ballasts. Alternatively, the pockets 14 may be adapted for storing equipment, tools, supplies and other objects having elongated or extended bodies or handles. Although the openings of the pockets 14 are shown to be semi-cylindrical in cross-section, they can also be fabricated or molded in a variety of polygonal shapes and sizes.

In one instance, hooks (not shown) may be incorporated on the front surface 15 of the flat panel 16 through the apertures 22 to facilitate fastening of U-shaped fluorescent light bulbs within the pockets 14. Alternatively, Velcro, straps, hooks or loop fasteners may be used to secure items that would otherwise ordinarily not fit within the slots 14 of the caddy 10. In other instances, the Velcro, straps, hooks or loop fasteners may be used to couple to another caddy 10 to form the dual-sided caddy 20 as previously described.

The caddy 10 integrates a flat panel 16 that supports the storage panel 12. In the alternative, the flat panel 16 is coupled to the storage panel 12 using known attachment means such as glue, adhesive and/or Velcro. The flat panel 16 can include additional slots, pockets or compartments (not shown) for added storage capability.

Figure 2:
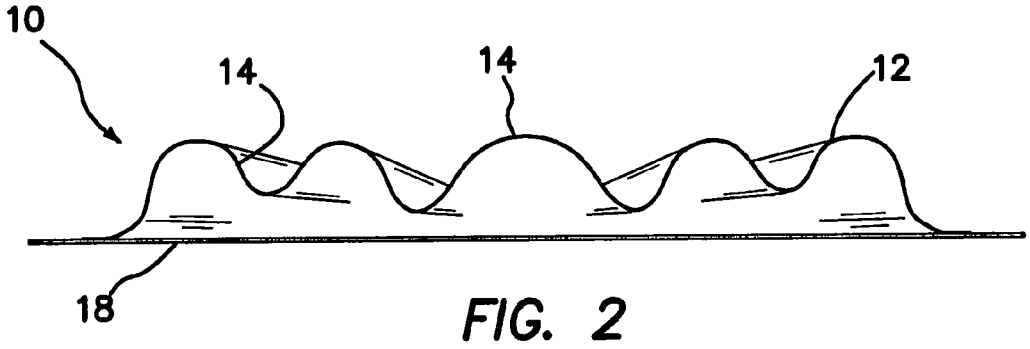
FIG. 2 illustrates a top view of the caddy.
Figure 3:
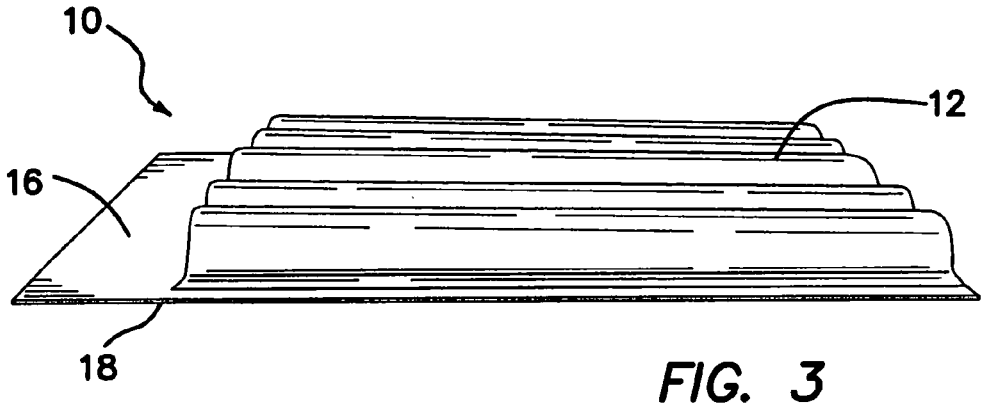
FIG. 3 illustrates a side view of the caddy.
Figure 4:
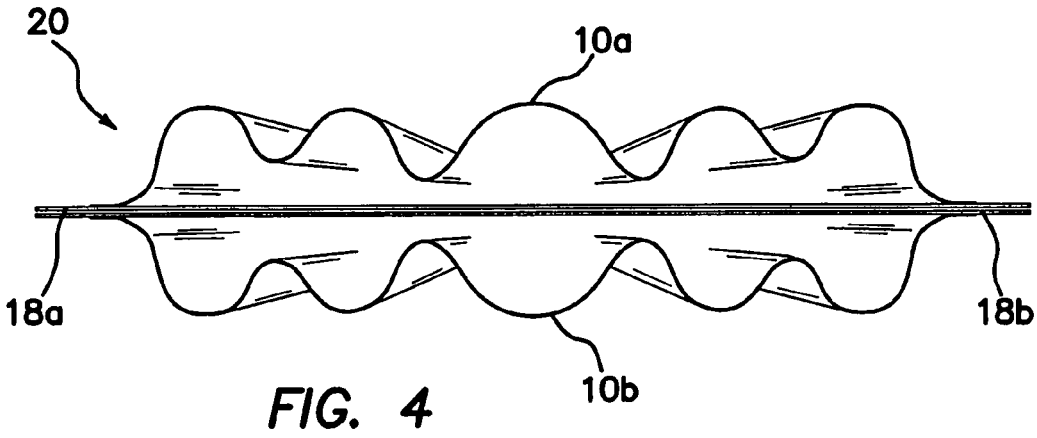
FIG. 4 illustrates a perspective view of a dual-sided caddy.

Reference is now made to FIGS. 2-3 illustrating top and side views, respectively, of the caddy 10. As shown in FIGS. 2-3, the flat panel 16 includes a front surface 15 and a rear surface 18. The rear surface 18 is substantially planar to facilitate coupling of the caddy 10 to various rigid objects including ladders, carts, vehicles or to another caddy 10. In other words, as shown in FIG. 4, a rear surface 18*a* of a first caddy 10*a* may be coupled to a rear surface 18*b* of a second caddy 10*b* to form a dual-sided caddy 20. The coupling may comprise the use of glue, adhesive and/or Velcro. Alternatively, the dual-sided caddy 20 may be coupled using other releasable fastener elements such as straps, hooks or buckles (not shown).

Figure 5:
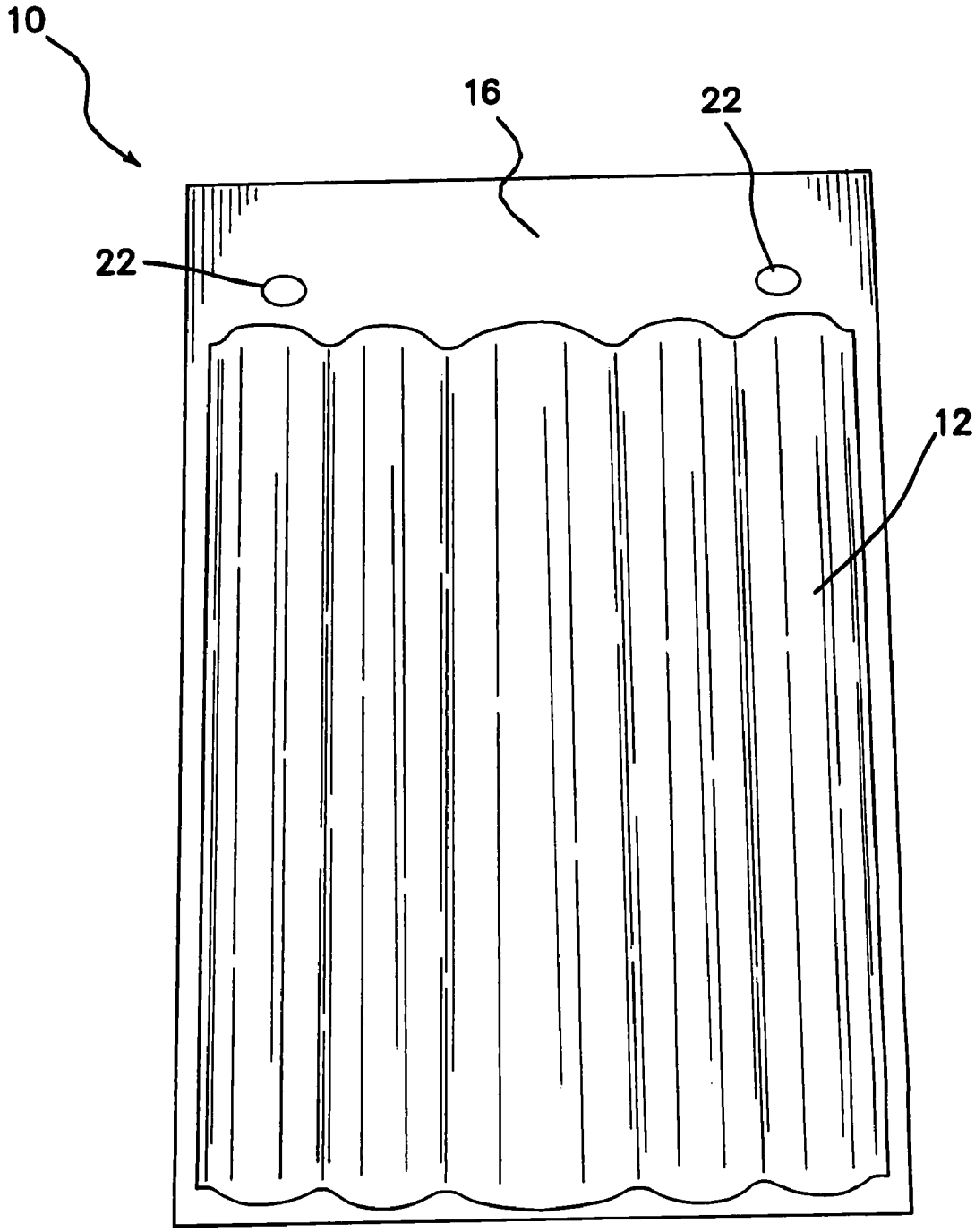
FIG. 5 illustrates a perspective view of the caddy having apertures.

Reference is now made to FIG. 5 illustrating the caddy 10 having two apertures 22 in the flat panel 16. Depending on the materials used to fabricate or mold the caddy 10, the apertures 22 can be formed using known sawing, drilling. molding or milling techniques. The openings of the apertures 22 can vary to allow a finger or an entire hand to fit therethrough to facilitate carrying or moving the caddy 10. Although only two apertures 22 are shown, there can be more or fewer apertures 22 as needed.

Figure 6:
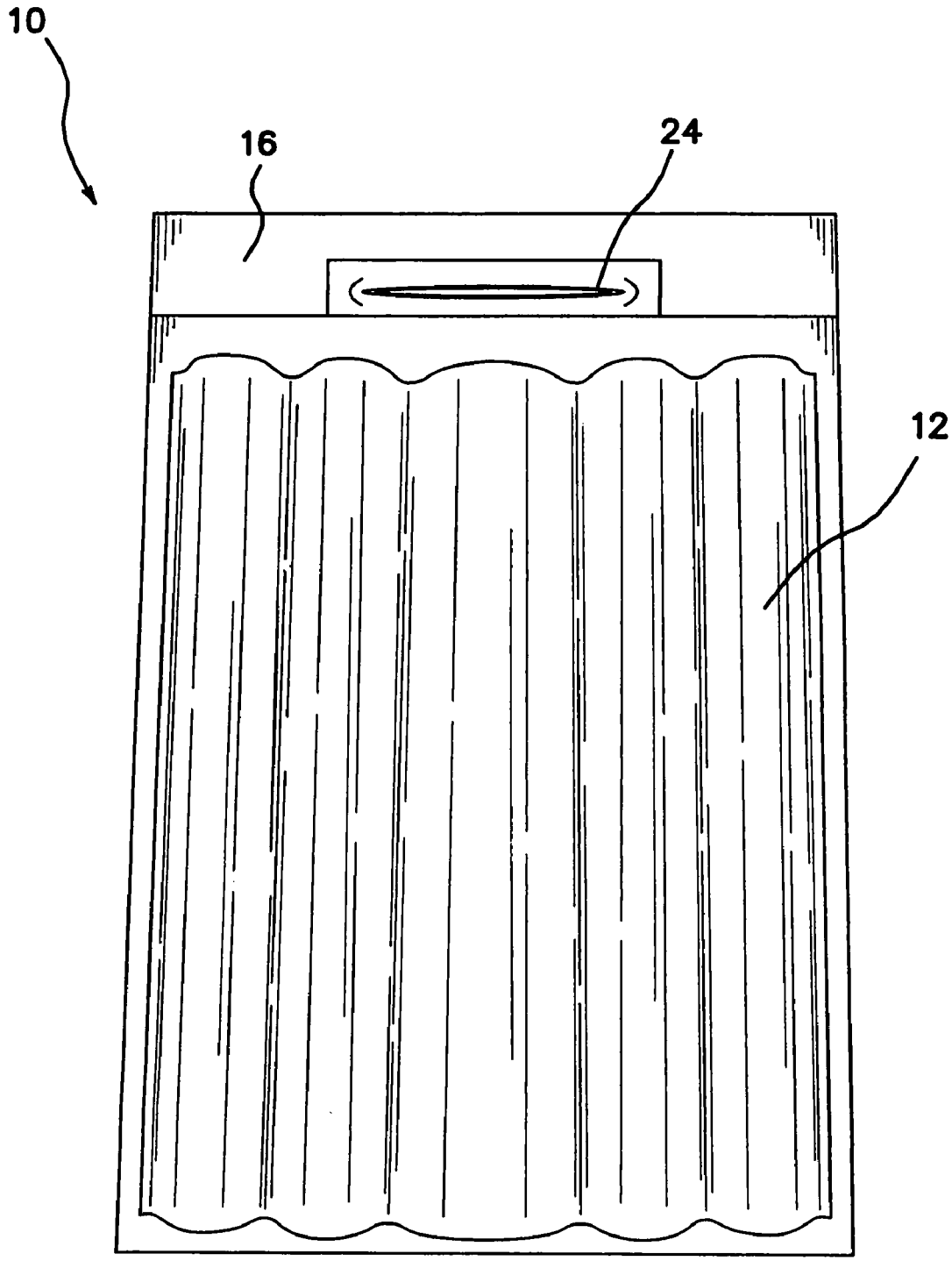
FIG. 6 illustrates a perspective view of the caddy having a handle.

Reference is now made to FIG. 6 illustrating the caddy 10 having a handle 24 formed on the flat panel 16. The handle 24 can be constructed or molded of plastic, metal or wooden material as that of the caddy 10 and integrated on the flat panel 16. Alternatively, the handle 24 can be coupled to the flat panel 16 using known fastening means such as screws and rivets. The handle 24 allows a user to readily carry or move the caddy 10. Although the handle 24 is shown adjacent to the storage panel 12, the handle 24 can also be formed on the rear surface 18 so as to not interfere with items that are stored within the slots 14.

Figure 7A:
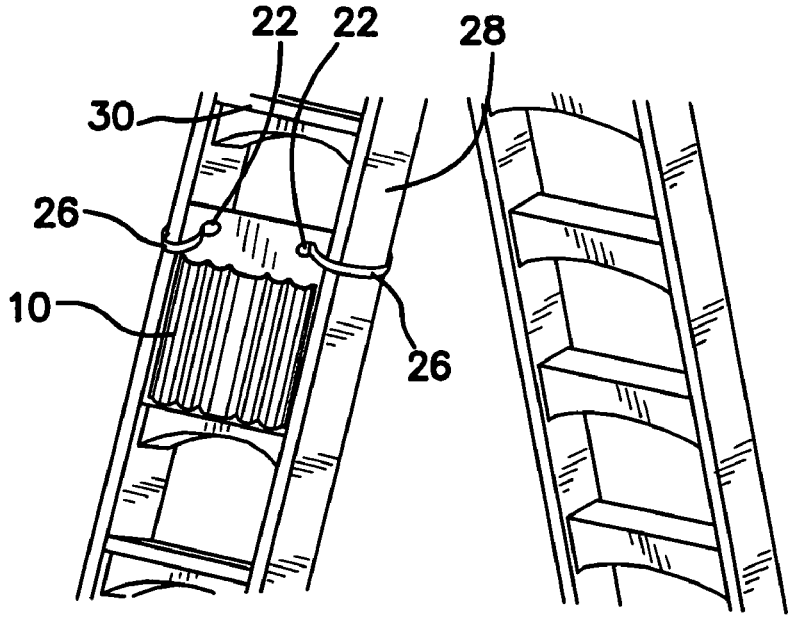
FIGS. 7A-7B illustrate the caddy connected to a ladder.
Figure 7B:
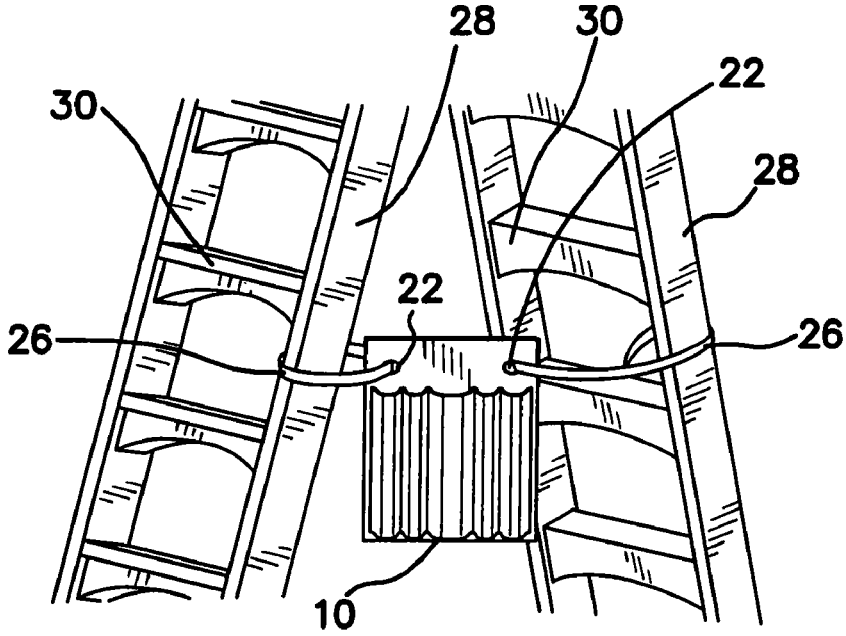

Reference is now made to FIGS. 7A-7B illustrating the caddy 10 attached to a ladder. As shown in FIG. 7A, the rear surface 18 of the caddy 10 can be mounted flush against a portion of the ladder so that slots 14 on the storage panel 12 can be used for retaining equipment, tools and supplies. Velcro, straps, hooks or loops having adjustable buckles and other fastening means 26 may be incorporated on the caddy

10 to facilitate coupling the caddy 10 to the side rails 28. Alternatively, the fastening means 26 may be used to couple the caddy 10 to the rungs 30 (not shown). In another instance, the caddy 10 may be coupled on two opposing side rails 28 using similar fastening means 26 as best shown in FIG. 7B. It will be appreciated by those skilled in the art that although a ladder is shown and described, the caddy 10 can be coupled to other rigid objects such as another caddy, a vehicle or a cart in similar fashion as described above. Also, although not shown, it is understood that the dual-sided caddy 20 can also be utilized with a ladder in a manner similar to that previously described for caddy 10.

Although the invention has been described in detail with reference to several embodiments, additional variations and modifications exist within the scope and spirit of the invention as described and defined in the following claims.

I claim:

1. A caddy comprising:

a flat panel having a front and rear surface;

a rigid front storage panel on a front surface of said flat panel, said front storage panel comprising a first series of elongated slots adapted to receive and retain fluorescent lights, a rigid rear storage panel on a rear surface of said flat panel, said rear storage panel comprising a second series of elongated slots adapted to receive and retain fluorescent ballast, said front and rear storage panels comprising a single member formed into a series of peaks and valleys which define the series of elongated slots; and fasteners for mounting the caddy to a ladder.

2. The caddy of claim 1 wherein the second series of one or more elongated slots have a greater diameter than said first series of elongated slots.

3. The caddy of claim 1, wherein the flat panel and storage panel are molded from plastic.

4. The caddy of claim 1, wherein the flat panel includes a handle.

5. The caddy of claim 1, wherein the flat panel includes apertures therethrough.

6. The caddy of claim 1, wherein the flat panel supports one or more hooks adapted to hold U-shaped fluorescent lights.

7. The caddy of claim 1, wherein one or more of the elongated slots adapted to receive and retain fluorescent ballast have larger diameters than the elongated slot adapted to receive and retain the fluorescent lights.

* * * * *